United States Patent [19]

Hurley

[11] 4,182,119

[45] Jan. 8, 1980

[54] AIR PUMP FOR TURBOFAN FUEL CONTROL SYSTEM

[75] Inventor: John F. Hurley, Huntington, Conn.

[73] Assignee: Avco Corporation, Stratford, Conn.

[21] Appl. No.: 829,652

[22] Filed: Sep. 1, 1977

[51] Int. Cl.[2] ..... F02K 39/04

[52] U.S. Cl. ..... 60/226 R; 60/39.07

[58] Field of Search ..... 60/39.07, 226 R, 262; 417/76, 80, 84, 87, 89, 159

[56] References Cited

U.S. PATENT DOCUMENTS 3,552,883 1/1971 Weatherbee ..... 417/76

FOREIGN PATENT DOCUMENTS 1199042 12/1959 France ..... 60/39.07

*Primary Examiner*—Louis J. Casaregola

*Attorney, Agent, or Firm*—Irwin P. Garfinkle; Robert J. McNair; Ralph D. Gelling

[57] ABSTRACT

This invention relates to apparatus which provides a positive flow of ambient air through the temperature sensor of the fuel control equipment used with a turbofan engine. The temperature sensing element of the fuel control unit is bathed in a continuously fresh sample of ambient air drawn in from the engine inlet by an air-jet pump that is powered by pressurized air bled-off from the bypass fan duct.

3 Claims, 5 Drawing Figures

AIR PUMP FOR TURBOFAN FUEL CONTROL SYSTEM

BACKGROUND OF THE INVENTION

The fuel needed to obtain specified thrust levels from a turbofan engine varies as a function of the temperature of the operating environment. To properly set fuel schedules, the standard fuel control equipment contains a bellows element. The bellows element responds to the temperature of the air in which it is bathed and then through mechanical linkages sets both inlet guide vane position and fuel flow schedules for the engine.

The task of supplying the sensing bellows with a continuous supply of fresh air has usually been achieved as follows. A small forward facing airscoop is placed in the inlet ducting in front of the forward fan stage. Tubing connects the airscoop to the inlet end of the fuel control equipment. At the outlet of the fuel control equipment another tube leads back to an aft facing discharge nozzle situated immediately in front of the forward fan stage. In theory the entering ram air will be picked up by the scoop, flow through the fuel control equipment and its associated bellows, then be drawn back by the suction of the rotating fan just downstream of the aft facing discharge nozzle. In practice, it has been found that with the system described above, the fuel control unit does not always get a supply of fresh ambient air. At certain flight speeds or under some crosswind conditions, standing waves or pressure nulls will build up in the vicinity of the airscoop and the aft facing nozzle. This condition can bring about stagnation of air flow at the sensing bellows under these flight regimes. The result is an erroneous fuel control setting. My invention corrects this problem by keeping a fresh supply of ambient air flowing past the bellows at all times.

The related art shows a broad range of fuel control equipment. U.S. Pat. No. 2,857,739 to Wright discloses an integrated fuel control system for a turbojet engine. Ambient air temperature, aircraft speed and altitude are all taken into account. The pilot controls the entire engine by a single manual control. In U.S. Pat. No. 3,091,080 to Crim et al, there is disclosed a fuel control system which combines the output of several engine condition sensors in order to derive a schedule for controlling the exhaust nozzle of an afterburning gas turbine engine.

In U.S. Pat. No. 3,460,554 to Johnson there is shown a control apparatus for positioning a shockwave in the diffuser associated with the compressor section of a jet engine. In U.S. Pat. No. 3,507,296 to Fix et al there is disclosed a fluid flow control apparatus which makes use of a bleed conduit to regulate the flow through a unit having a nozzle discharging a high pressure fluid through a supersonic diffuser section.

None of the above achieves what my invention discloses. It is an object of my invention to provide a positive flow of engine inlet air past the temperature sensing element of the fuel control unit. It is a further objective of the invention to provide a reliable flow of air without the use of mechanically moving parts.

SUMMARY OF THE INVENTION

This invention relates to an improved way of forcing air to flow through the ambient temperature sensor of the fuel control system used with a turbofan engine. The apparatus includes the use of a single stage air ejector pump which forces ambient air through the fuel control system. The air ejector pump is powered by pressurized air bled off from the fan bypass duct.

The entire system comprises the following units. A projecting scoop samples the ambient air at the inlet cowling of the engine. The airscoop terminates in a short length of tubing to which is clamped one end of a piece of flexible conduit. The second end of the conduit is clamped to the inlet side of a fuel control assembly. In the unit reduced to practice, the fuel control assembly was a Model JFC-31 built by Hamilton Standard. There is an air passage through this fuel control assembly that allows ambient air to flow past a temperature sensing bellows. The outlet side of the fuel control assembly is connected to a second section of conduit. The other end of this second section of conduit is connected to the suction chamber side of the air ejector pump.

The single stage air ejector pump has three parts, namely, a suction chamber, a diffuser and an air nozzle. Pressurized air, bled off from the fan bypass duct of the engine is fed to the pump air nozzle by means of a third section of conduit. The nozzle is convergent so that the gas passing through undergoes both an increase in velocity and a drop in pressure. The nozzle extends into the suction chamber with the outlet orifice of the nozzle pointing toward the diffuser. Thus, the high velocity gas exiting the nozzle orifice in the direction of the diffuser tends to draw the contents of the suction chamber along, acting as a pump.

The outlet of the diffuser section of the air ejector pump has a fourth section of conduit connected thereto. This fourth section of conduit terminates at an air nozzle whose outlet end is just in front of the main fan blades of the turbofan engine. Thus, the air ejector pump serves to continuously draw ambient air through the fuel control assembly. The pump has no moving parts and it operates on the pressurized air which is always present in the bypass fan ducts of an engine operating under flight conditions.

DESCRIPTION OF THE PREFERRED EMBODIMENT

Figure 1:
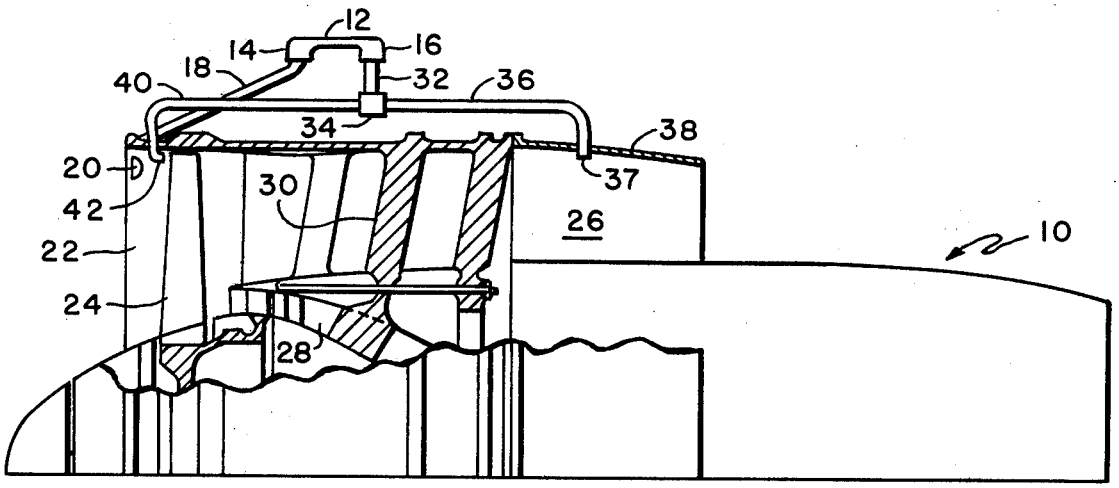
FIG. 1 is a partially cutaway view of a turbofan engine having the fuel control and air ejector pump mounted thereon, the lower portion of the engine being omitted.

Referring to FIG. 1, there is shown a partially cutaway view of a turbofan engine 10. The fuel control assembly 12 for this engine is depicted at the top. It will be understood that in actual practice, fuel control assembly 12 is secured by bolt means to the engine casing and that there are other connections from the fuel control assembly to the engine. In the unit reduced to practice a Hamilton Standard Model JFC-31-19 fuel control assembly was used. A detailed description of a similar Hamilton Standard fuel control unit is to be found in "Jet Aircraft Power Systems" by J. V. Casamassa and R. D. Bent, McGraw-Hill Book Company, 3rd Edition, pages 109–113.

What is shown in FIG. 1 is a fuel control assembly 12 having an ambient air inlet 14 and an air outlet 16. Within the body of assembly 12 there is assumed to be an air passageway (not shown) that allows an air sample to flow past a temperature sensing bellows. It will be understood that en toto the fuel control assembly schedules fuel to the engine in response to signals of engine speed, pressure within the combustor, ambient air pressure and compressor inlet temperature. Of these, my invention deals only with the temperature of the air at the inlet to the compressor.

Ambient air is supplied to fuel control assembly 12 by air supply conduit 18. Inlet air is collected by an airscoop 20 which is mounted in a forward facing direction in the engine cowling 22 ahead of bypass compressor fan 24.

Intake air compressed by bypass compressor fan 24 flows both along bypass duct 26 and along annular ducting 28. Compressed air in ducting 28 is delivered to the main compressor stage of the turbine engine (not shown). Strut 30 serves to provide structural integrity for the bypass fan stage of the engine.

Figure 3:
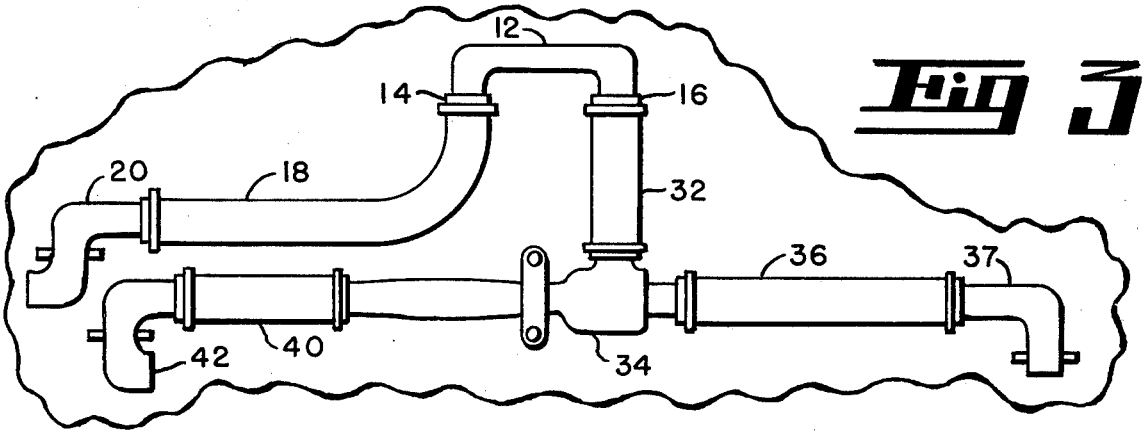
FIG. 3 is a top plan view of the fuel control assembly, an ejector pump and associated hardware.

Ambient air passing through fuel control assembly 12 exits through air outlet 16 into exhaust conduit 32. (See FIG. 3 for clarity). The second end of exhaust conduit 32 is attached to the suction chamber connection of air ejector pump 34. Ejector supply air conduit 36, at one end attaches to pipe section 37 which penetrates outer wall 38 of bypass duct 26. At its second end, ejector supply air conduit 36 is attached to the ejector nozzle connection of air ejector pump 34. The diffuser end of air ejector pump 34 is attached to mixed flow return conduit 40, the exhaust end of which is coupled to aft facing air nozzle 42 which is positioned just in front of bypass compressor fan 24.

Figure 4:
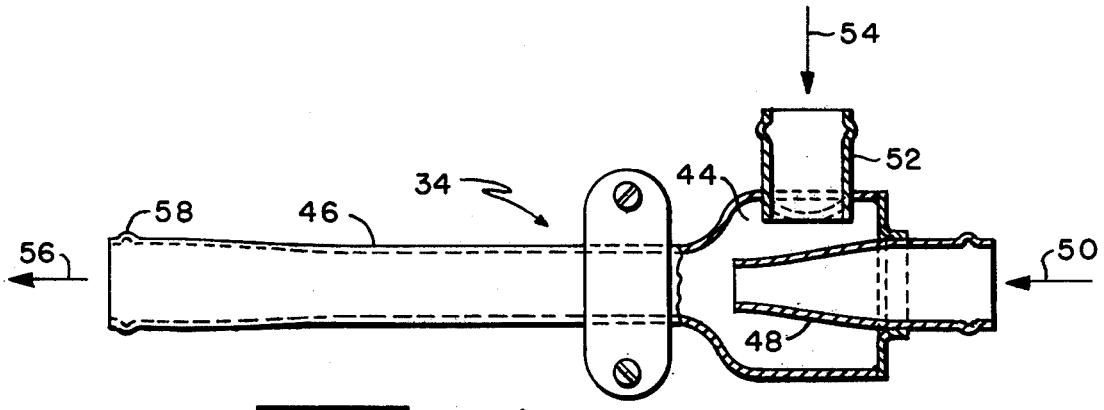
FIG. 4 is a cross sectional view of the air ejector pump.

FIG. 4 shows a cross sectional view of single stage air ejector pump 34. The pump consists of a suction chamber 44, a mixing chamber-diffuser 46 and an air nozzle 48. Suction chamber 44 in combination with mixing chamber-diffuser 46 form a venturi.

Air nozzle 48, when connected to a source of pressurized air 50, will discharge a high velocity jet of air across suction chamber 44. Suction chamber 44 has an inlet 52 thereto, which is connected to the source 54 that is to be evacuated. The gas to be evacuated is entrained by the high velocity jet of air issuing forth from air nozzle 48. The gases from sources 50 and 54 stream into the mixing chamber-diffuser 46 where they mix and the velocity energy of the mixture is converted into pressure. The pressurized mixture of gases 56 flows out of the exhaust end 58 of the diffuser.

Figure 2:
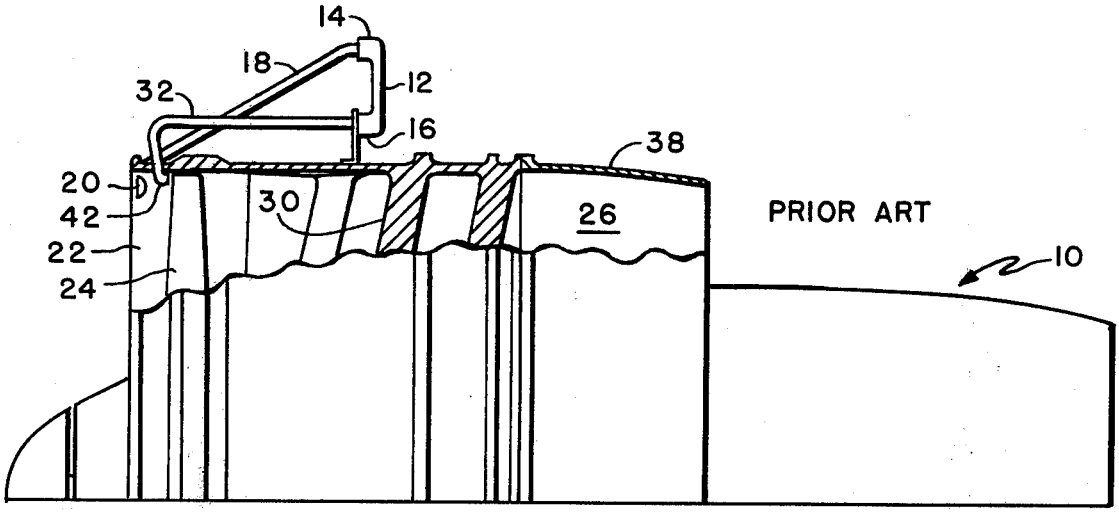
FIG. 2 is a partially cutaway view of a turbofan engine having a prior art fuel control system.

The FIG. 1 implementation differs appreciably from the prior art system which is shown in FIG. 2. In FIG. 2 like components have been labeled the same as depicted in FIG. 1. There is a turbofan engine 10 having a bypass compressor fan 24, a strut 30 and a bypass duct 26. Fuel control assembly 12 is assumed to have the necessary linkages to properly schedule an optimized amount of fuel into the engine. Only ambient air inlet 14 and ambient air outlet 16 are shown on fuel control assembly 12. The supply of ambient air to operate the temperature sensor element in fuel control assembly 12 is brought in via air supply conduit 18. The input end of supply conduit 18 is attached to airscoop 20 which is mounted in the engine cowling 22. The ambient air outlet 16 of fuel control assembly 12 is connected to aft facing nozzle 42 by exhaust conduit 32.

Figure 5:
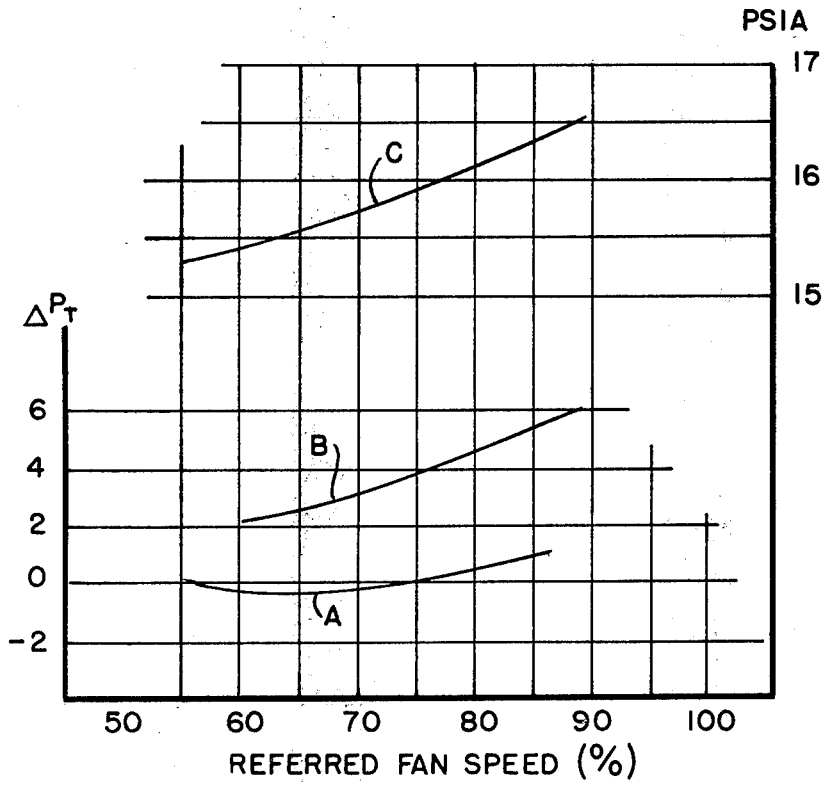
FIG. 5 is a graph showing the improved performance obtained from use of the air ejector pump.

Flow of ambient air through the fuel control assembly of the FIG. 2 prior art system implies that a pressure differential exists between the entrance to airscoop 20 and aft facing nozzle 42. Temperature and pressure measurements made on a test engine showed that stable flow through the prior art FIG. 2 system did not occur. These test results are shown in FIG. 5. Graph A is a plot of the pressure differential $\Delta P_T$ as a function of fan speed with $\Delta P_T$ being measured between air inlet 14 and air outlet 16 for the FIG. 2 prior art implementation. Referred fan speed is shown as a percent of rated design speed modified by the temperature coefficient. As can be seen in Graph A, the pressure across the fuel control assembly 12 starts out positive near the half speed region, goes to zero, then reverses direction, again goes to zero and finally remains positive for all speeds above 75 percent rated. With performance such as this, the temperature compensation feature of the fuel control assembly cannot be relied to function in an optimum manner.

Graph B of FIG. 5 shows what the addition of the air ejector pump accomplishes. Graph B data was taken from the FIG. 1 system implementation. It depicts the measured pressure differential $\Delta P_T$ across the Hamilton Standard Model JFC-31-19 fuel control assembly for the system reduced to practice. As shown in Graph B, the incorporation of my invention brings about a positive flow of ambient air through the temperature sensing element of the fuel control assembly. Flow remains positive for all speeds and the differential pressure increases as fan speed approaches rated design limits. The pressure supplied to the ejector nozzle 48 (See FIG. 4) under operating conditions is shown in Graph C of FIG. 5. Graph C shows that the pressure delivered to the ejector nozzle connection of the air ejector pump is from 0.5 to 1.5 pounds per square inch above atmospheric, over the referred fan speed range of 55 to 85 percent after taking into account all conduit and bleed-off port losses. This amount of pressure at the air ejector nozzle was found able to accomplish the pumping results shown in Graph B of FIG. 5.

In order to accommodate my concepts to structurally different bypass fan turbine engines, various modifications can be made with regard to the particular structures illustrated. The detailed description given above is not intended to limit the scope of this invention. It is intended that equivalent devices and materials can be substituted in this combination without deviating from the scope of the claims.

I claim:

1. For a fan type aircraft turbine engine utilizing a bypass air duct and having a fuel control assembly for scheduling engine fuel flow in response to varying conditions of aircraft altitude, speed and ambient air temperature, said ambient air temperature being measured from a sample of air taken via a small forward facing air scoop placed at the air intake of the engine and conveyed via conduit means to said fuel control assembly for bathing the inlet air temperature sensing probe therein with a continuously renewed sample of ambient air, the sample of air being conducted away from the fuel control assembly via a second conduit which delivers the air sample to an aft facing nozzle directly in front of the forward compressor fan stage, the improvement comprising:

higher pressure air sampling means for obtaining bleed off air from the engine bypass air duct;

an air ejector pump having two inputs and an exhaust, said pump being powered via its first input by the higher pressure air sampling means, said second input in communication with the output of said fuel control assembly and serving to continuously draw ambient air samples therefrom; and conduit means for delivering the exhaust from said air ejector pump to said aft facing nozzle.

2. The invention according to claim 1 wherein the air ejector pump comprises:

a suction chamber having an inlet at one end, the entrance to said inlet being in communication with the output of said fuel control assembly;

a convergent nozzle attached to one side of said suction chamber and extending into said suction chamber at right angles to said inlet with the outlet orifice of said nozzle being concentric with the axis of said chamber, the inlet side of said nozzle being in communication with a source of higher pressure air; and a diffuser section attached to the opposite side of said suction chamber having an output serving as the exhaust side of said air pumping means, the input end of said diffuser section being in communication with the interior of said suction chamber, the axis of said diffuser being coaxial with the axis of said convergent nozzle whereby high velocity gas exiting the nozzle orifice in the direction of the diffuser tends to draw the contents of the suction chamber along, acting as a pump.

3. The invention according to claim 1 wherein the source of higher pressure air is supplied to said convergent nozzle at pressures between 15 and 17 pounds per square inch absolute over the operating speed range of said engine.

* * * * *